US006044593A

United States Patent [19]

Puls

[11] Patent Number: 6,044,593

[45] Date of Patent: Apr. 4, 2000

[54] FREE HANGING CANOPY

[76] Inventor: John L. Puls, Villas Del Mar, 903 Pinellas Bay Way, #107, Tierra Verde, Fla. 33715

[21] Appl. No.: 09/014,650

[22] Filed: Jan. 28, 1998

[51] Int. Cl.[7] ..... E04B 7/00

[52] U.S. Cl. ..... 52/74; 52/643; 52/650.3

[58] Field of Search ..... 52/73, 74, 75, 52/76, 77, 78, 643, 650.3

[56] References Cited

U.S. PATENT DOCUMENTS

| | | | |
|---|---|---|---|
| 1,995,345 | 3/1935 | Golden | 52/73 |
| 2,332,059 | 10/1943 | Cheshier | 52/643 |
| 2,352,884 | 7/1944 | Brinker | 52/643 |
| 2,503,136 | 4/1950 | Simpson | 52/77 |
| 2,541,784 | 2/1951 | Shannon | 52/643 |
| 2,629,904 | 3/1953 | Bristow | 52/77 |
| 2,699,823 | 1/1955 | Zveibil | 52/75 |
| 2,714,233 | 8/1955 | Martin | 52/77 |
| 2,764,107 | 9/1956 | Niswonger et al. | 52/643 |
| 2,807,061 | 9/1957 | Stone | 52/74 |
| 2,943,366 | 7/1960 | Sanford | 52/73 |

*Primary Examiner*—Michael Safavi
*Attorney, Agent, or Firm*—Pendorf & Cutliff

[57] ABSTRACT

A free-hanging metal canopy that can be attached to an existing building structure, or incorporated into one in its original construction. The canopy can extend up to twelve feet from a building structure, and is comprised of a framework, a covering, and an attachment means. The canopy framework height, ranging from 1 to 4 feet high, making the canopy visually appealing and useful with single-level building structures. In one embodiment, the canopy can be folded down from a raised to a lowered position.

18 Claims, 7 Drawing Sheets

FREE HANGING CANOPY

BACKGROUND OF THE INVENTION

1. Field of the Invention

The present invention relates to a canopy for a building so as to provide an area of shelter against sun, rain, snow, sleet, or other elements. The canopy can be mounted onto an existing building structure. It is capable of supporting the weight of snow and ice, and can withstand wind forces of tropical storm magnitude.

2. Description of the Related Art

Various types of canopies are known in the art. When viewed from the side, they are generally shaped like right triangles, with a generally vertical side, a generally horizontal side, and a sloping hypotenuse side.

One type of canopy is free-hanging (i.e. having no support posts) and generally comprises a framework and a covering, and is mounted onto an existing wall. See for example U.S. Pat. Nos. 5,299,395, 2,565,282, 2,629,904, and 2,644,990. U.S. Pat. No. 5,299,395 teaches a canopy for overhanging a door or window. U.S. Pat. No. 2,565,282 teaches an awning for protecting windows or doorways from the sun or rain. U.S. Pat. No. 2,629,904 teaches a readily disassembled metal awning for porches and patios. U.S. Pat. No. 2,644,990 teaches a metallic awning apparently designed for placement over windows and doorways. However, all of these prior art canopies and awnings extend only three to six feet beyond their wall of attachment. To extend these canopies beyond six feet would provide a problem twofold. First, the canopies would not be able to withstand heavy winds or the effects of heavy snowstorms and ice storms; the weight of the snow and ice or the force of the winds would collapse the canopy structure. U.S. Pat. No. 2,629,904, avoids this problem by providing a structure that can be easily be disassembled during the winter months, when heavy snowfalls and ice storms would present a problem. Second, extending the canopy out from the building with a longer horizontal side (when viewed from the side) would also require an extended vertical side. This vertical extension would make the canopy "taller" and impossible to install on a single level building due to the building's height restrictions. For example, by extending the U.S. Pat. No. 2,629,904 awning beyond six feet, the vertical side, or height of the awning, would have to extend beyond 2'7" (as the height of the awning is roughly 0.45 times the extension of the canopy). Such a vertical extension could not be tolerated with on most single level homes where the bottom of the canopy is placed at least seven feet above ground level. The impracticality of a vertical extension becomes even more apparent in U.S. Pat. Nos. 5,299,395, 2,565,282, and 2,644,990, where the canopy height to canopy extension ratio is larger.

One method of increasing the distance that a canopy can extend from a building is to provide a canopy with vertical supports, or support poles, distal to the canopy's point of attachment to the building. However this canopy support structure can pose a problem, especially in a commercial setting, where vehicles are regularly maneuvered around the support poles. Not only do the vertical supports provide an inconvenience to drivers, but also the entire canopy becomes a liability in the event that one of the vertical supports is damaged in a collision, thereby causing the canopy to collapse.

Another way of increasing the distance that a canopy structure can extend beyond a building structure is to integrate the canopy structure into the building structure.

This incorporation does not ensure that the structure of the canopy itself will be able to endure excessive forces. However, by incorporating the canopy into the building structure, there is not as much stress at the lowest point where the canopy is attached to the building, and so the canopy can be further extended without fear that the canopy will "break off" from the point of attachment. See for example U.S. Pat Nos. 2,903,752 and 2,260,369. U.S. Pat. No. 2,903,752 discloses a parking structure for motor vehicles comprising a canopy. The canopy is actually an extension of the parking structure's roof, the roof and canopy being supported by all of the parking structure walls. U. S. Pat. No. 2,260,369 teaches a framework for a collapsible and portable structure to be used in combination with another such structure to form the framework for a temporary airplane hangar. The framework for the hangar comprises extendible roof supporting beams.

While the canopy art supplies many different types of canopies, it provides no suggestion as to how to make a free hanging canopy that can extend beyond six feet off of a building and still maintain its structural integrity in the presence of severe weather at both the position of attachment to the building and across the entire canopy surface, wherein the canopy can be mounted onto an existing wall and wherein the canopy does not have a large vertical aspect or side, so as to make the canopy impossible to mount onto the limited wall space of a single level building structure.

There is thus a need for a free hanging canopy structure that can be attached to an existing building structure that can extend out from the building structure from six to twelve feet. The canopy must also be able to withstand heavy loads typically associated with heavy snowfalls and ice storms in the north, and must be able to withstand both downward and upward forces of tropical storm gales frequently encountered in the coastal states. The canopy structure should also have a vertical framework height that makes it useful for attachment to single level buildings.

SUMMARY OF THE INVENTION

It is therefore an object of the invention to provide an all metal free-hanging canopy structure that can extend anywhere from four to twelve feet out from it's wall of attachment.

It is further an object of the present invention to provide a free-hanging canopy that is strong and durable, so as to be able to withstand the weight of snow and ice that it will carry in the northern regions of the country, and the forces of tropical storm winds that it will encounter in the coastal states.

It is further an object of the present invention to provide a free-hanging canopy that can be attached to an existing building structure.

It is further an object of the present invention to provide a free-hanging canopy extending from six to twelve feet with a vertical element that is from 1' to 4' high, thereby making it practicable to attach the canopy to a single level structure. Preferably, the free-hanging canopy has a vertical element that is from 1' to 3' high.

It is further an object of the present invention to provide a free-hanging canopy that is made of a light gauge metal so as to make the canopy economical to manufacture, ship and install.

It is further an object of the present invention to provide a free-hanging canopy with an aesthetically appealing structure.

These and other objects of the present invention have been accomplished by providing a free-hanging metal canopy that comprises a framework, a covering, and a connecting means, wherein the framework comprises a plurality of generally right-triangle-shaped trusses which may be arranged in parallel and a plurality of transverse members that connect the trusses. Each truss is comprised of a vertical member, a horizontal member that is longer than the vertical member, and a hypotenuse member. The trusses can be spaced anywhere from 2 to 5 feet apart. In a preferred embodiment, the trusses are spaced about 4 feet apart. The vertical member contacts the building structure. Further, the trusses have a strengthening members. In on embodiment, the trusses comprise a plurality of struts that connect a truss's hypotenuse member to its horizontal member. In the preferred embodiment, the strengthening members are comprised of a plurality of vertical struts disposed in each of the trusses and a plurality of diagonal struts extending generally from the top of a vertical strut in a decline towards the bottom of the adjacent vertical strut proximal to the vertical member of the strut.

In one embodiment, the trusses are in the shape of a truncated right triangles, where the truncated portion of the structure is most distal to the building structure. In this embodiment, each truss is truncated by a bisecting member that connects the hypotenuse member and horizontal member.

Further, the free-hanging canopy has an inclined top covering, which covers the top of the framework. In the preferred embodiment, the inclined top covering is comprised of a roof decking of 26-gauge metal. It would be clear to one of ordinary skill in the art that numerous metal roofing designs could be utilized with the canopy of the present invention, including the metal roofing described in the above cited patents.

The canopy may also have a bottom covering that covers the bottom of the framework, and two side coverings that cover the sides of the framework.

The canopy also has an affixing means adapted for connecting at least two of the vertical members to a building structure. Most preferably, the canopy will be affixed to a building at every strut's vertical member.

The canopy can be designed to extend anywhere from 6 to 12 feet beyond a building, but in the preferred embodiment, the canopy is designed to extend from six to twelve feet beyond the building structure.

BRIEF DESCRIPTION OF THE DRAWINGS

In order to facilitate an understanding of the invention, the invention will be discussed with reference to the drawings, wherein there is shown.

DETAILED DESCRIPTION OF THE INVENTION

The free-hanging metal canopy of the present invention can be constructed so as to be strong and durable, capable of bearing heavy loads of snow and ice, and of withstanding wind forces typically encountered in tropical storms. The canopy does not need to be built into a new construction, but can actually be attached to an existing building structure. The canopy is designed to extend from six to twelve feet beyond a building. The canopy is comprised of a framework, a covering for the framework, and an attachment means designed for attaching the canopy to a building structure. The free-hanging canopy framework is from one to four feet high, making the canopy visually appealing and practicable for use with a single-level building structure.

Figure 1:
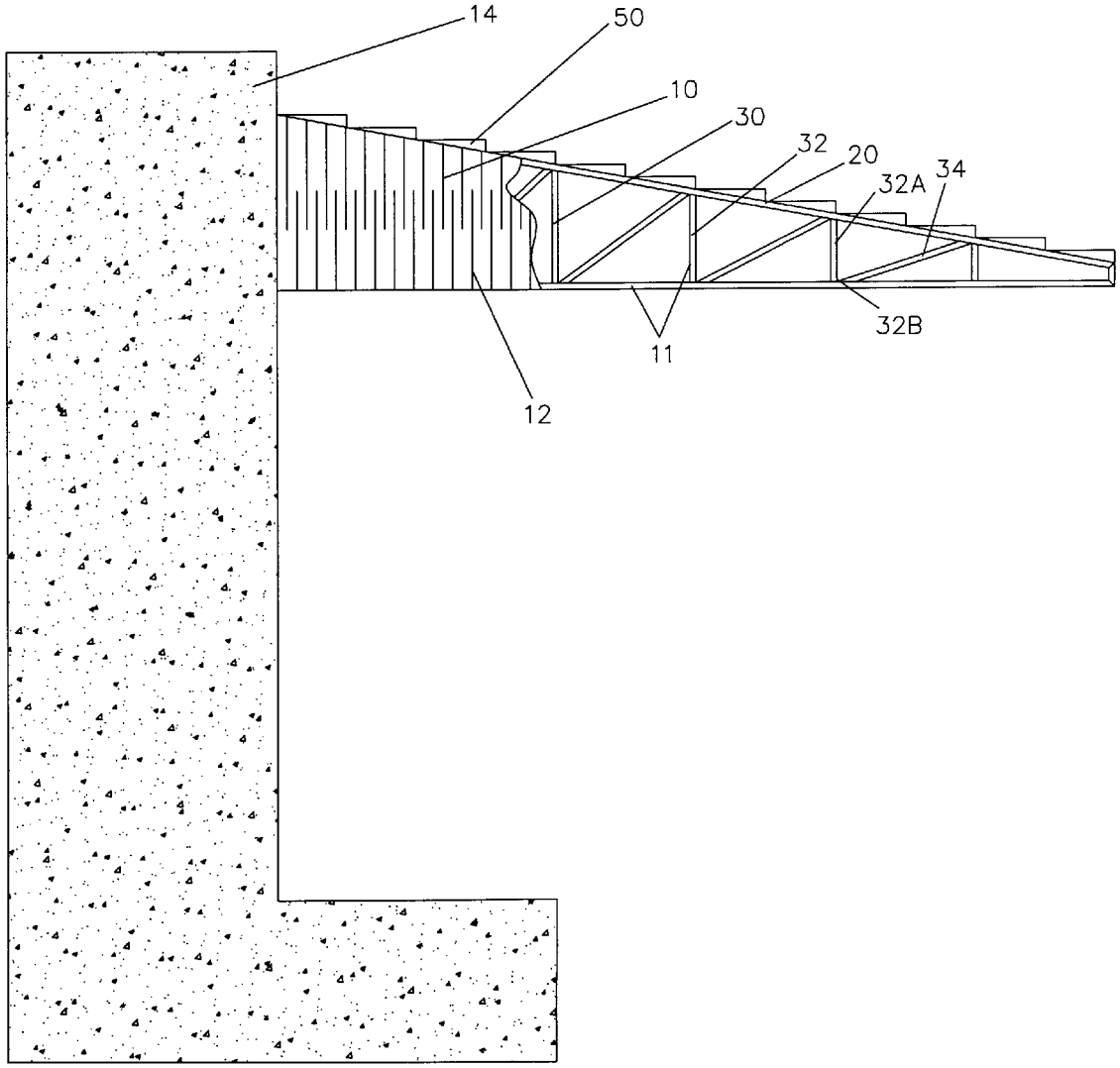
FIG. 1 is a side view of a 12 foot free-hanging canopy with the side covering partially broken away to illustrate the truncated truss structure.
Figure 4:
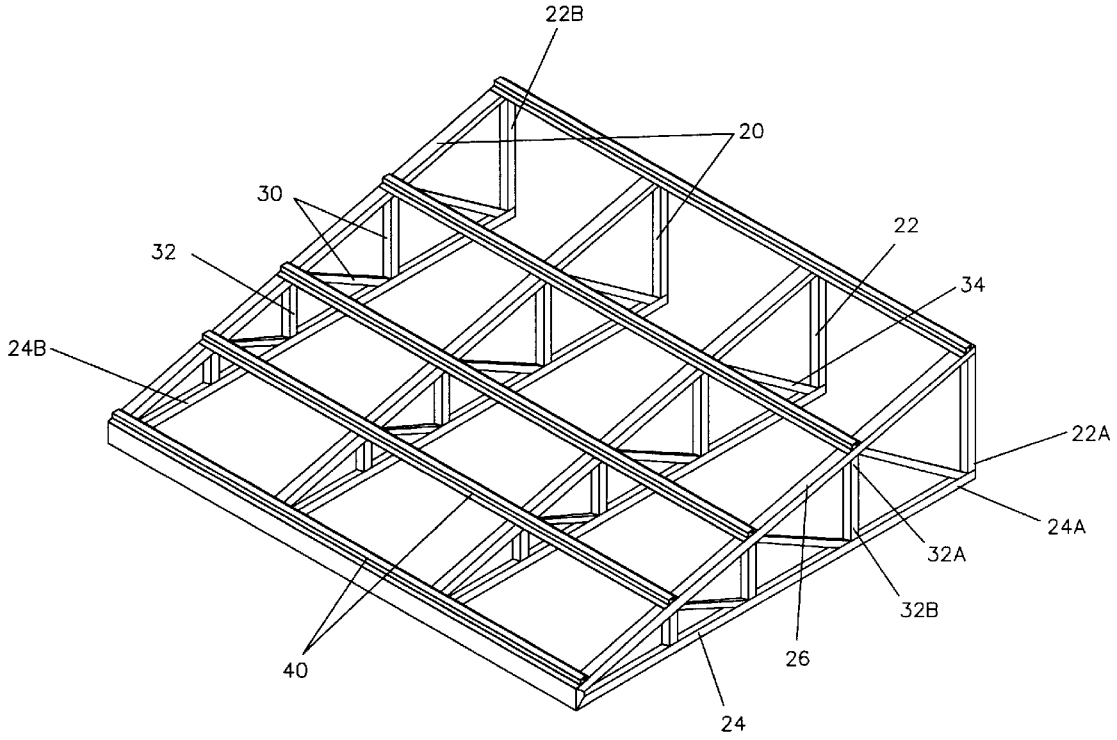
FIG. 4 is a perspective view of the trusses and transverse members.

The free-hanging metal canopy 10 according to the present invention as shown in FIG. 1 is designed to be mounted onto the side of an existing building structure 14. It should be understood that the canopy 10 could also be erected with a building that is under original construction. The canopy 10 is generally comprised of a framework 11, a covering for the framework 12, and a means designed for attaching the framework to a building. The framework 11 is generally comprised of a plurality of trusses 20 and a plurality of transverse members that connect the trusses. Each truss is comprised of a vertical member 22, a horizontal member 24 that is longer than the vertical member 22, and a hypotenuse member 26 which are connected to generally form a right triangle. It is preferred that the generally right-triangle-shaped trusses 20 be arranged in parallel (FIG. 4).

In one embodiment, each vertical member 22, horizontal member 24, and hypotenuse member 26 have a first end 22A, 24A, 26A and a second end 22B, 24B, 26B. The first end 24A of the horizontal member 24 is affixed to the first end 22A of the vertical member 22, so that the two members are joined to form generally a right angle. The hypotenuse member 26 slopes downwardly on an incline so as to connect the second ends 24B, 26B of the hypotenuse and vertical members to one another so as to generally form a right triangle.

Figure 2:
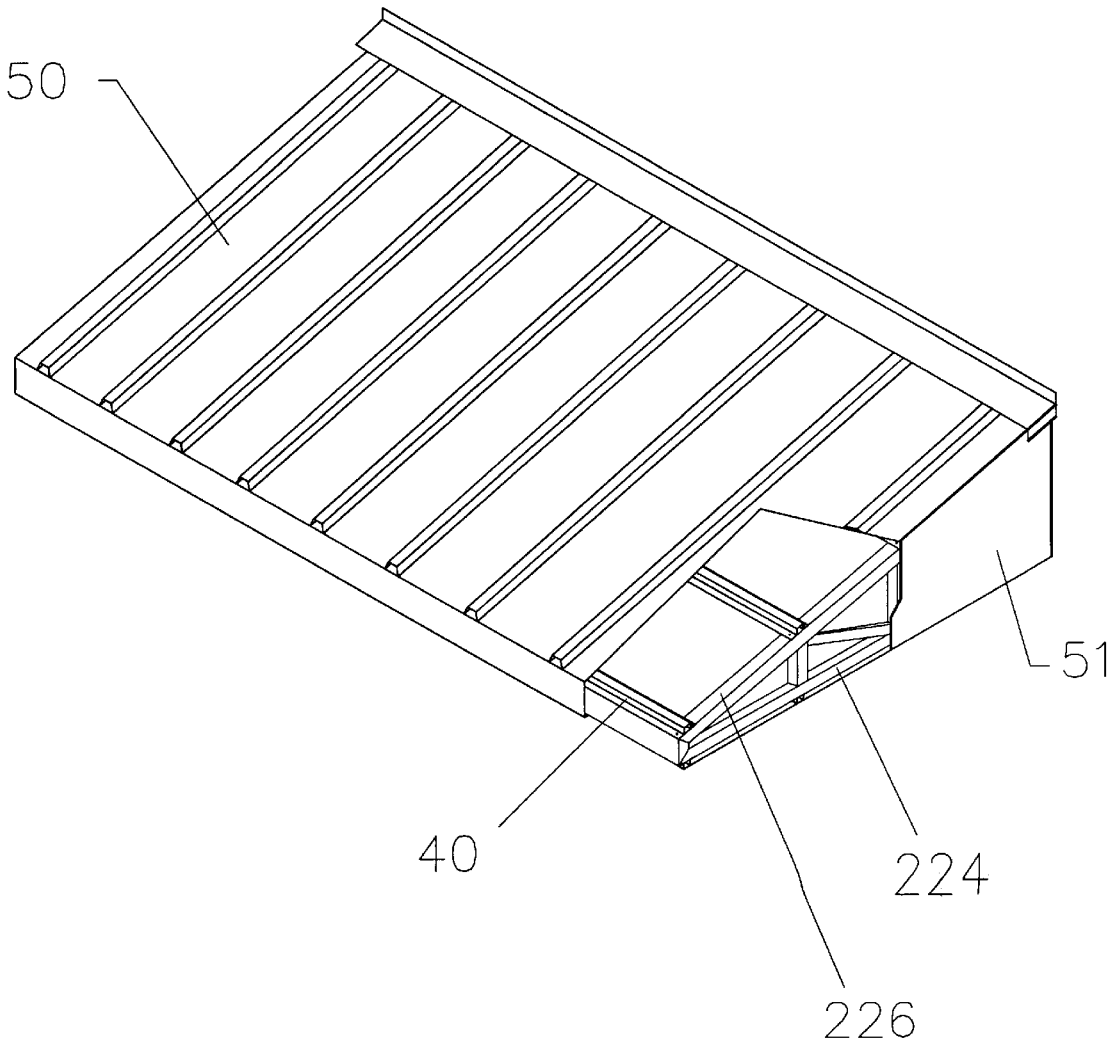
FIG. 2 is a perspective view of the canopy with the top and side covering partially broken away to illustrate the truncated truss and transverse members.
Figure 3:
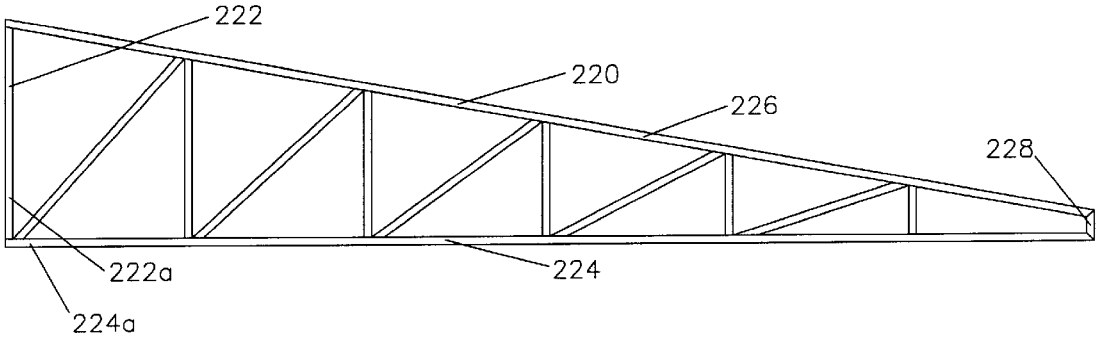
FIG. 3 is a side view of a 12 foot truncated truss.

In another embodiment (FIGS. 2,3), the right triangle-shaped trusses 220 are truncated, comprised of a vertical member 22, a horizontal member 224 that is longer than the vertical member 22, a hypotenuse member 226, and a bisecting member 228.

In the preferred embodiment (FIG. 3), the vertical member 222, horizontal member 224, hypotenuse member 226, and bisecting member 228 each having a first end 222A, 224A, 226A, 228A and a second end 222B, 224B, 226B, 228B. The first end 222A of the vertical member 222 is similarly affixed to the first end 224A of the horizontal member 224. Also similarly, the first end 226A of the hypotenuse member 226 is affixed to the second end 222B of the vertical member 222. The hypotenuse member 226 slopes downwardly towards said horizontal member second end 224B. However, before the second end 226B of the hypotenuse member 226 reaches the horizontal member 224, the bisecting member 228 affixes said second end 226B of said hypotenuse member 226 to said second end 224B of said horizontal member 224. Thus, in this embodiment, the truss is shaped as a truncated right triangle.

The vertical member 22 of the truss 20 is designed to be in contact with a building structure 14. It is preferred that the ratio of the horizontal member 24 to vertical member 22 be in the range of 3:1 to 6:1. By maintaining a short vertical member 22, the canopy can readily be used with single level building structures.

The trusses 20, 220 are further comprised of a strengthening members 30. In the preferred embodiment, the strengthening members 30 comprise a plurality of struts connecting the hypotenuse member of a truss to its horizontal member. In the preferred embodiment, the strengthening members comprise a plurality of vertical struts 32 with a top 32A and a bottom 32B disposed in each of the trusses 20, 220 and a plurality of diagonal struts 34 extending generally from the top 32A of a vertical strut 32 in a decline towards the bottom 32B of the adjacent vertical strut 32 proximal to the vertical member 22, 222 of the truss 20, 220. The vertical struts are spaced two feet apart.

The trusses 20, 220 can be spaced anywhere from 3 to 5 feet apart. In the preferred embodiment, four trusses are arranged four feet apart and arranged in parallel. In the preferred embodiment, the trusses are further comprised of 14 gauge, 1" square tubing. One could use any type of metal to form the truss, including stainless steel, galvanized metal, and aluminum.

In addition to a plurality of trusses 20, the canopy framework 11 further comprises a plurality of transverse members 40 that connect the trusses 20. In the preferred embodiment, the transverse members 40 lie in parallel and perpendicularly to the hypotenuse members 26. The transverse members 40 preferably lie across the hypotenuse members of the plurality of trusses 20 and positioned above the vertical struts 32 of the strengthening members of the trusses 20. In the preferred embodiment, the transverse cross members are made of 14-gauge, 1" square tubing.

Further, the free-hanging canopy 10 has an inclined top covering 50 that covers the top of the framework 11. In the preferred embodiment, the inclined top covering 50 is comprised of a roof decking of 26-gauge metal. Specifically, the roof decking is a series of 36" panels that are run lengthwise across the top of the framework 11. It would be clear to one of ordinary skill in the art that numerous aesthetically appealing metal roofing designs could be utilized with the canopy of the present invention, including the metal roofing described in the above cited patents. The canopy also has vertical lateral coverings 51 that cover the sides of the framework. Numerous aesthetically pleasing designs could be placed on the canopy's lateral surfaces.

One embodiment of the free-hanging canopy 10 also has a horizontal bottom covering (not shown) that covers the bottom of the framework 11. Any type of material could be used on the ventral surface so as to provide the canopy 10 with an aesthetically pleasing appearance.

Figure 5:
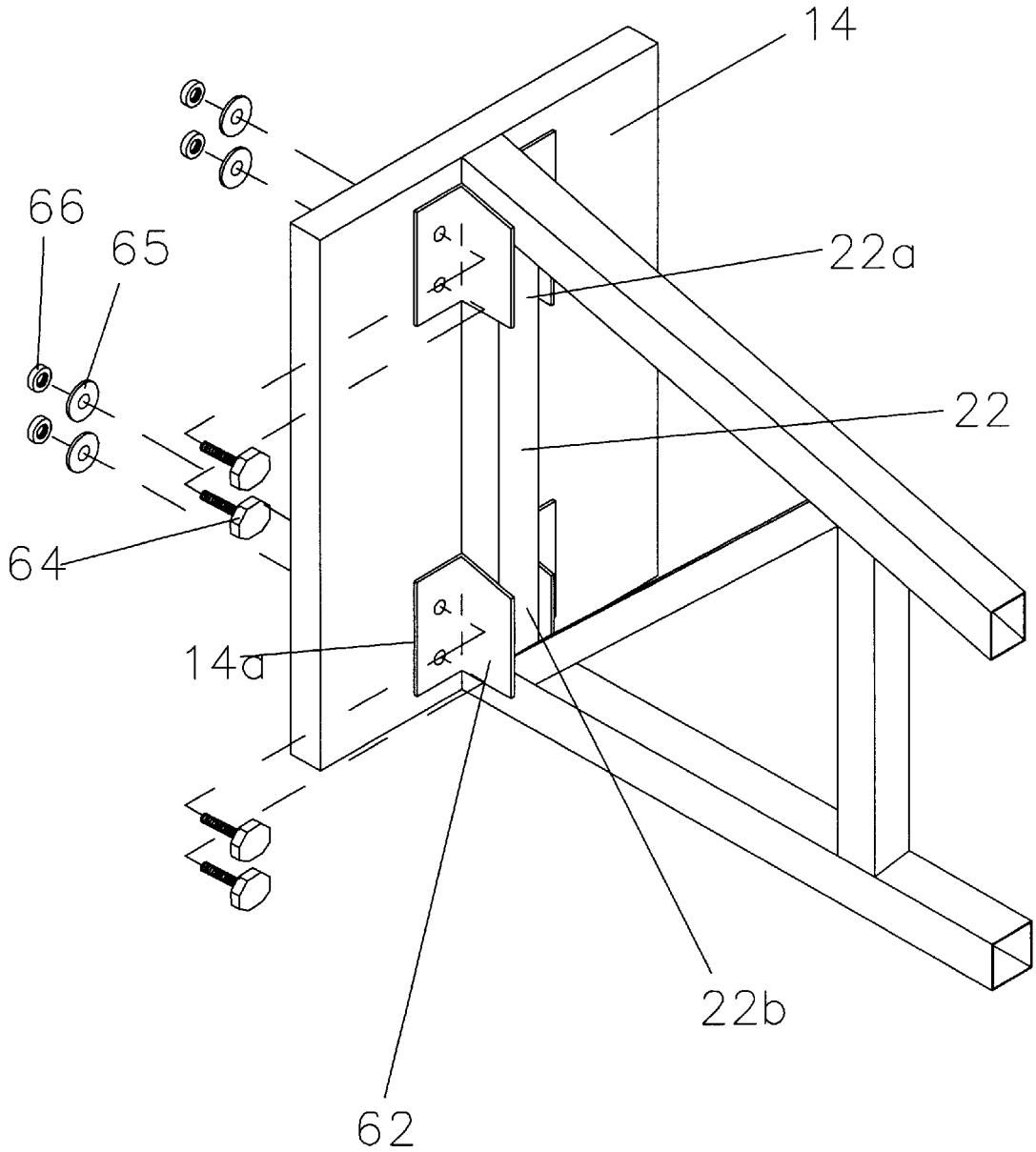
FIG. 5 is a perspective view of one of the trusses as attached to the cement wall of a building structure, where the attaching means involves through-bolting.
Figure 6:
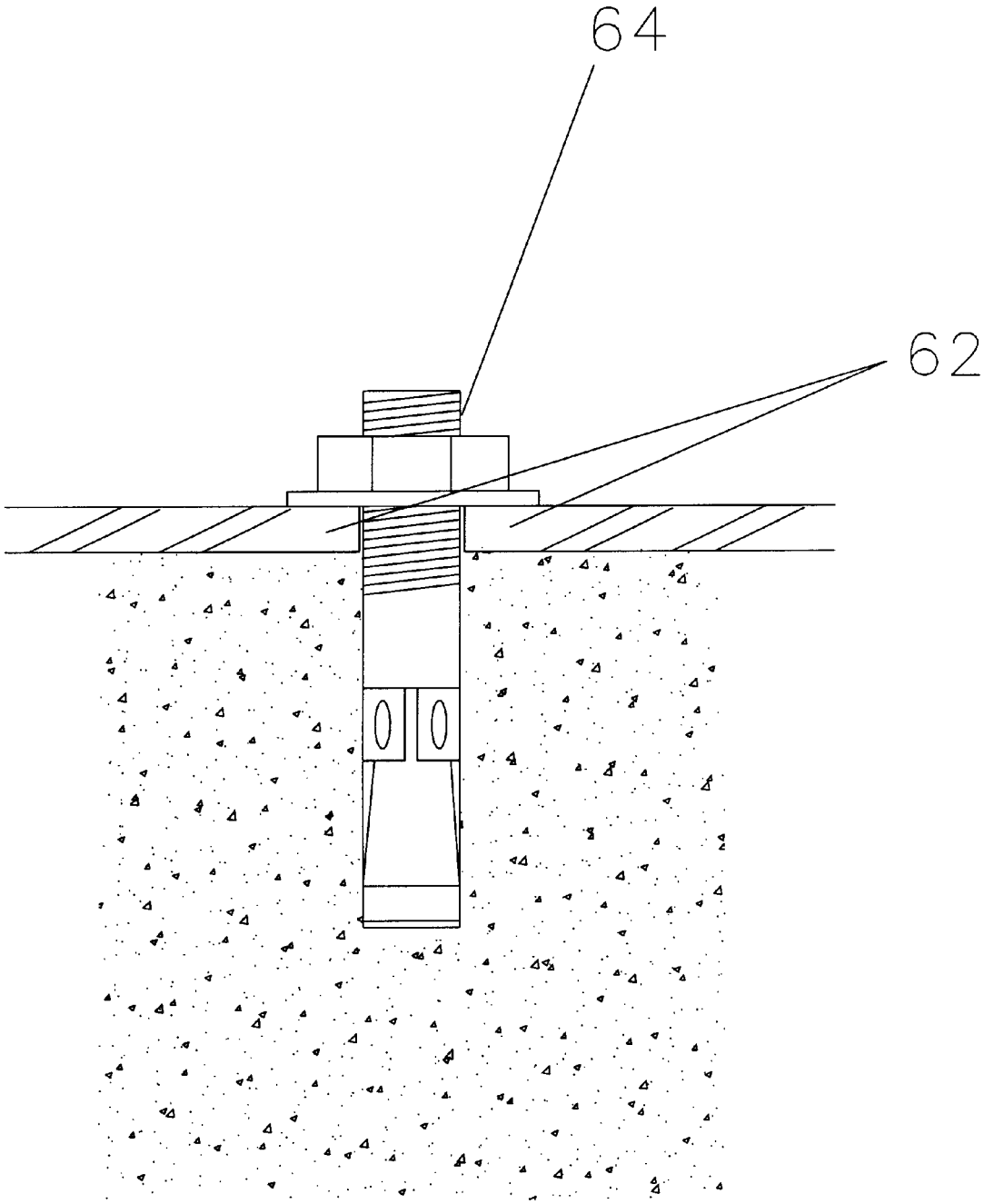
FIG. 6 is a cross sectional view of a bolt attaching the trusses to a solid concrete wall using a wedge anchor.

The canopy 10 is further comprised of an affixing means 60 designed to connect at least two of the vertical members 22, 222 to a building structure (FIGS. 5, 6). Most preferably, every vertical member 22, 222 will be attached to the building structure. In the preferred embodiment, the affixing means two steel angles 62, preferably—2" by 2" by 3/16" steel angles, are positioned on both sides of the vertical member 22 at both the top end 22A and the bottom end 22B. Each steel angle 62 can be either bolted or welded to the vertical member.

Depending on the building structure's strength and surface material, the affixing means will vary. It is crucial that each anchoring site 14A, 390A of the affixing means provide 1500 lbs. tensile strength.

Where the free-hanging canopy 10 is to be affixed to concrete block or brick, or any building structural beam (FIG. 5), a through-bolting technique can be used. Preferably at least one—3/8" diameter hex bolt 64 will be utilized per 2" by 2" by 3/16" angle, along with a 3/8" lock nut 66 and high strength plate washer 65 (2" diameter, 1/8" thick). The length of the hex bolt will vary, but can be anywhere from 3" to 18" long. The width can be greater than 3/8". It is crucial that the bolt be able to provide 1500 lbs. tensile strength.

Where the canopy is to be attached to a solid concrete header, preferably at least one 3/8"×3" wedge anchor is used per steel angle, along with a 3/8" lock nut and high strength plate washer. Again, the length of the wedge anchor can vary, as can the width, as long as the wedge anchor can provide 1500 lbs. tensile strength.

Where the canopy 10 is not affixed to a concrete structure, or at a support beam of the building structure, the truss vertical members 22 could be attached to support plate located in front of or behind the building structure's surface for attachment so as to accommodate the load of the canopy 10.

In yet another embodiment, the canopy is a fold-down canopy. In this embodiment, the affixing means is comprised of at least one upper affixing means and a lower affixing means, wherein said upper affixing means is releasably attachable, and wherein said lower affixing means is pivotably attachable. In this embodiment, when the upper affixing means is not attached, the canopy can pivot from a raised position generally parallel with the ground (and generally perpendicular to the building) to a lowered position generally perpendicular to the ground (and generally parallel with the building). The folding canopy embodiment can be designed to support smaller loads (up to 150 lbs), as the canopy can easily be taken down in severe weather conditions.

In one embodiment of the fold-down canopy, a single steel angle extends the entire length of each side of the vertical members, the steel angles are designed to be attached to a building structure. The steel angles are attached to the vertical members by at least two 3/8" by 2½ hex bolts, S Grade 5 Steel with lock nut and washer. Preferably, three bolts attach the steel angles to the vertical members. One bolt passes through an orifice in the steel angle proximal to the bottom of the vertical member, through an orifice in the vertical member, and then through an orifice in the steel angle on the other side of the vertical member. Similarly, any number of bolts can attach the steel angles to the vertical members along the length of the vertical members. When all of the bolts are in place, the canopy is in an upright, raised position. However, all of the bolts except the bottom bolt can be easily removed so that the canopy can pivot along the bottom bolts from the raised position (parallel to the ground) to a lowered position (generally perpendicular to the ground).

Other attachment means can be used in the fold-down canopy. For example, a plurality of smaller steel angles can be placed the entire length of each side of the vertical members that are designed to be attached to a building structure.

Figure 7:
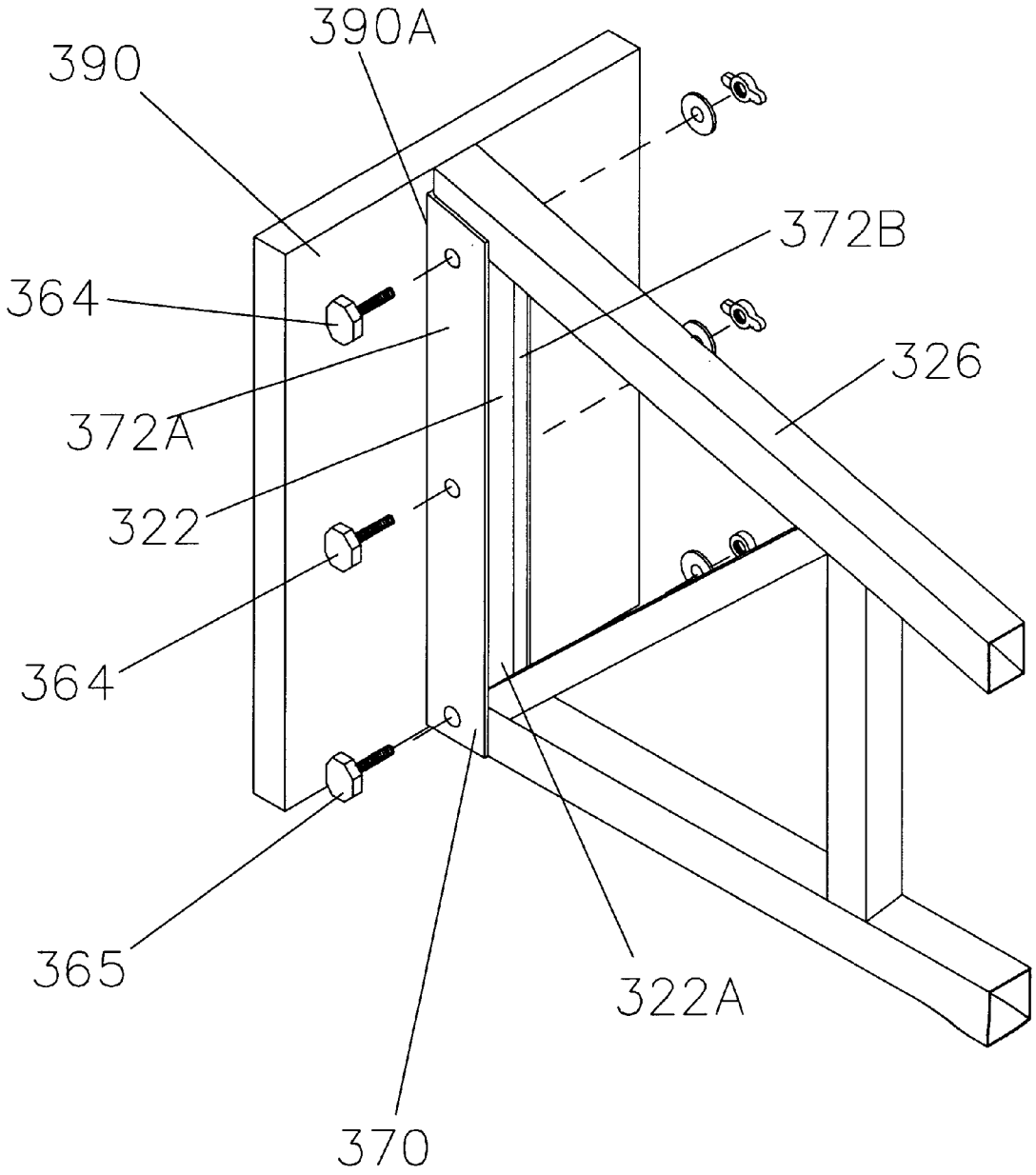
FIG. 7 is a perspective view of one of the fold-down canopies as attached to a wall with a U-channel.

In a preferred embodiment, at least two vertical U-shaped channels 370, designed to be attached to a building structure at the anchoring site 390A, can be attached to a building structure at the bottom of the U-shaped channel (FIG. 7). The U shaped channel 370 preferably has a length roughly equal to the length of the vertical members 322. A vertical member 322 can be placed inside each U-shaped channel 370 and held in place by at least two bolts 364, preferably 3/8", hex bolts with washers and nuts. The bolts traverse one of the sides 372A of the U-shaped channel, an orifice in the vertical member (not shown), and the other side 372B of the channel. At least one of the bolts 365 would be located proximal to the bottom of the vertical member 322A. When all of the bolts 364, 365 are in place, the canopy is in a raised, upright position. When all of the bolts are removed from each channel except the bottom bolts 365, the canopy will pivot along the bottom bolts 365 which pass through the at least two vertical members 322 from the raised position, generally parallel to the ground, to a lowered position, generally perpendicular to the ground.

The free-hanging canopy of the present invention can extend from four to twelve feet from a building structure. In the preferred embodiment, the structure extends from six to twelve feet. In spite of the length of the extension, the canopy still has a low vertical aspect (or height), with the horizontal member length to vertical member length ratio ranging from 3:1 to 6:1, most preferably from 4:1 to 6:1.

EXAMPLE 1

A free hanging canopy was constructed wherein the trusses were in the shape of truncated right triangles, with strengthening members comprising vertical struts spaced apart every two feet, and diagonal struts connecting the top of the vertical struts with the bottoms of the adjacent vertical struts proximal to the vertical member. All of the components of the truss were welded together. The canopy extended 8 feet, and three vertical struts were spaced every two feet. The vertical member had a height of 1'9 ⅓", and the bisecting member had a height of 2". Four trusses were spaced in parallel four feet apart. 14-gauge 1' square tubing was used to construct the trusses, as well as to construct the transverse/cross members. The cross members connected the four trusses and extended across the vertical struts and in accordance with the spacing of the vertical struts. 26-gauge metal roofing was used for the top cover. All four vertical members were attached to four vertical beams or plurality of steel angles 62 with ⅜" hexagonal bolts as described above.

EXAMPLE 2

A free hanging canopy was constructed wherein the trusses were in the shape of truncated right triangles, with strengthening members comprising vertical struts spaced apart every two feet, and diagonal struts connecting the top of the vertical struts with the bottoms of the adjacent vertical struts proximal to the vertical member. All of the components of the truss were welded together. The canopy extended 12 feet, and five vertical struts were spaced every two feet. The vertical member had a height of 2'7", and the bisecting member had a height of 4". Four trusses were spaced in parallel four feet apart. 14-gauge 1' square tubing was used to construct the trusses, as well as to construct the cross members. The cross members connected the four trusses and extended across the vertical struts. 26-gauge metal roofing was used for the top cover. All four vertical members were attached to four vertical beams or U-shaped channels 370B with ⅜" hexagonal bolts as described above.

Next, forty-four 100-lb. bags of concrete mix were placed on top of the canopy inclined top surface for a period of one hour. The load did not structurally damage the canopy. The canopy was not severed from the vertical beams.

The foregoing detailed description and the accompanying drawings are provided for purposes of describing and illustrating presently preferred embodiments of the invention. It is understood that the present disclosure of the preferred form has been made only by way of example, and that numerous changes in the details of structures and the composition of the system may be resorted to without departing from the spirit and scope of this invention.

Now that the invention has been described,

What is claimed is:

1. A free-hanging metal canopy comprising:

a framework comprising a plurality of trusses and transverse members, wherein each truss is comprised of a vertical member, a horizontal member that is longer than said vertical member, and a hypotenuse member generally defining a right triangle and wherein said trusses include strengthening members, and wherein said transverse members are positioned across the hypotenuse member of each truss to connect the trusses in a parallel arrangement;

an inclined top covering which covers the top of said framework; and an affixing means designed for connecting at least two of said vertical members to a building structure at an anchoring site, and said affixing means comprises an upper affixing means and lower affixing means connected to the anchoring site that provides at least 1500 lbs. tensile strength, and wherein said upper affixing means is releasably attachable, and said lower affixing means is pivotably attachable.

2. The canopy of claim 1, wherein a bisecting member truncates each of said trusses and connects said hypotenuse member and said horizontal member of said trusses, wherein the truncated portion of said trusses are designed to be distal to a building structure.

3. The canopy of claim 2, further comprising a generally horizontal bottom which covers the bottom of said framework.

4. The free-hanging canopy of claim 1, wherein the ratio of the horizontal member length to vertical member length is in the range of 3:1 to 6:1.

5. The free-hanging canopy of claim 1, wherein the ratio of the horizontal member length to vertical member length is in the range of 4:1 to 6:1.

6. The free-hanging canopy of claim 1, wherein the ratio of the horizontal member length to vertical member length is in the range of 4.5:1 to 6:1.

7. The free-hanging canopy of claim 1, wherein the ratio of the horizontal member length to vertical member length is in the range of 5:1 to 6:1.

8. The canopy of claim 1, wherein said transverse members are arranged in parallel and has a spatial distance equal to a spacing of the strengthening members.

9. The canopy of claim 5, wherein said horizontal member is between 6 and 12 feet in length.

10. The canopy of claim 5, wherein said horizontal member is between 7 and 12 feet in length.

11. The canopy of claim 5, wherein said horizontal member is between 8 and 12 feet in length.

12. The canopy of claim 1, wherein each said truss include a plurality of struts connecting said hypotenuse member and said horizontal member.

13. The canopy of claim 1, wherein said trusses are spaced from 2 to 5 feet apart.

14. The canopy of claim 1, wherein said framework has a bottom side and two lateral sides, further comprising a covering that covers said bottom of said framework, and two coverings that cover said lateral sides of said framework.

15. The canopy of claim 1, wherein said affixing means comprises a ⅜" by 3" to 18" hexagonal bolt which can be through-bolted to a building structure wall or beam.

16. The canopy of claim 1, wherein said inclined top covering is comprised of 26-gauge metal.

17. The canopy of claim 1, wherein said framework is comprised of 14 gauge metal.

18. The canopy of claim 1, wherein the vertical member length is 0.216 times the horizontal member length.

* * * * *